US005827108A

United States Patent [19]

Spector

[11] Patent Number: 5,827,108

[45] Date of Patent: Oct. 27, 1998

[54] VARIABLE-LENGTH TWIRLABLE BATON

[76] Inventor: Donald Spector, 380 Mountain Rd., Union City, N.J. 07080

[21] Appl. No.: 996,766

[22] Filed: Dec. 23, 1997

[51] Int. Cl.[6] ..... A63H 33/00

[52] U.S. Cl. ..... 446/266; 84/477 B

[58] Field of Search ..... 14/2.4; 56/6; 84/471; 114/66.5 H; 244/46; 273/84 R; 446/266; 473/568

[56] References Cited

U.S. PATENT DOCUMENTS

| | | | |
|---|---|---|---|
| 2,812,683 | 11/1957 | Harrold et al. | 446/266 |
| 2,956,369 | 10/1960 | Rolin | 446/266 |
| 3,069,804 | 12/1962 | Cirafesi | 446/266 |
| 3,173,688 | 3/1965 | Green | 473/568 |
| 3,636,811 | 1/1972 | Bailey | 84/477 B |
| 3,962,949 | 6/1976 | Trowbridge et al. | 446/266 |
| 5,149,092 | 9/1992 | Parsons | 273/84 R |
| 5,348,297 | 9/1994 | Parsons | 273/84 R |

*Primary Examiner*—Robert A. Hafer
*Assistant Examiner*—Michael B. Priddy
*Attorney, Agent, or Firm*—Michael Ebert

[57] ABSTRACT

A baton useable by a drum major or by any other user capable of twirling the baton and in doing so varying its overall length the baton including an open-ended main tube that can be grasped by the user, the tube being divided by an internal transverse beam into opposing half sections. Telescoped into each half section through the open end thereof is a cylindrical rod having secured to its outer end a weighted ball. The inner end of each rod is connected by an elastic band to the beam whereby in the static state of the baton the balls are equidistant from the beam and the baton has a predetermined overall length. When a user twirls the baton, the resultant centrifugal forces acting on the balls causes the rods to advance outwardly to lengthen the baton to an extent that depends on the twirling velocity. A diminishing action causes the rods to retract into the half sections of the tube to shorten the baton. When the baton is used as a shaft and is hurled toward the ground so that an end ball strikes the ground, the shaft then rebounds toward the hurler.

7 Claims, 1 Drawing Sheet

VARIABLE-LENGTH TWIRLABLE BATON

BACKGROUND OF THE INVENTION

1. Field of Invention

This invention relates generally to a baton for use by drum majors and majorettes as well as by others capable of twirling a baton, and more particularly to a baton of this type which when twirled, then varies in length to a degree that depends on the twirling velocity.

2. Status of Prior Art

The term baton has multiple meanings. Thus a policeman's billy club which serves as a weapon is often called a baton. A stick or wand used by a leader to conduct a band or orchestra is also called a baton. The type of baton which is the concern of the present invention is a baton used by a drum major or majorette who leads a marching drum corps or band and who precedes the band or orchestra in the line of march.

A drum major or majorette grasps the baton in one hand and executes various movements therewith, the most common of which is a twirling action in which the baton is swung in a circle. The conventional baton for this purpose is a smooth staff with a balancing ball at one end.

The typical drum major or majorette is a theatrical figure who wears a colorful uniform or costume and plays a vital role in the dramatic impact made by the marching band on spectators along the line of march. This impact is heightened when the performer is capable of twirling the baton at high velocity and on occasion throwing the baton into the air and then catching it.

But a conventional baton is of moderate length and the faster it is twirled the less visible it is to spectators. It is somewhat like seeing an action-packed drama on a small TV screen, for the greater the amount of activity taking place in a given scene, the more difficult it becomes for the viewer to see what is going on.

SUMMARY OF INVENTION

In view of the foregoing, the main object of this invention is to provide a baton useable by a drum major or majorette or by any other user capable of twirling a baton, the baton being adapted to vary in length as it is being twirled.

More specifically an object of the invention is to provide a baton of the above type in which a pair of opposing cylindrical rods are telescoped into opposite ends of an open-ended main tube, whereby as the baton is twirled, the rods advance outwardly to vary the overall length of the baton.

A significant feature of the invention is that secured to the outer end of each rod is a weighted ball, which balls act to balance the baton. The balls at opposing ends of the baton, when the baton is twirled, are subjected to centrifugal forces causing the rods to pull out of the main tube.

A significant feature of the invention is that the weighted balls at the ends of the baton are rubber balls, and when the baton is used as a shaft and hurled toward the ground, the shaft when striking the ground then rebounds toward the hurler.

Briefly stated, these objects are attained by a baton useable by a drum major or by any other user capable of twirling the baton and in doing so varying its overall length. The baton includes an open-ended main tube that can be grasped by the user, the tube being divided by an internal transverse beam into opposing half sections. Telescoped into each half section through the open end thereof is a cylindrical rod having secured to its outer end a weighted ball. The inner end of each rod is connected by an elastic band to the beam whereby in the static state of the baton the balls are equidistant from the beam and the baton has a predetermined overall length.

When a user twirls the baton, the resultant centrifugal forces acting on the balls causes the rods to advance outwardly to lengthen the baton to an extent that depends on the twirling velocity. A diminishing action causes the rods to retract into the half sections of the tube to shorten the baton. When the baton is used as a shaft and is hurled toward the ground so that an end ball strikes the ground, the shaft then rebounds toward the hurler.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 2:
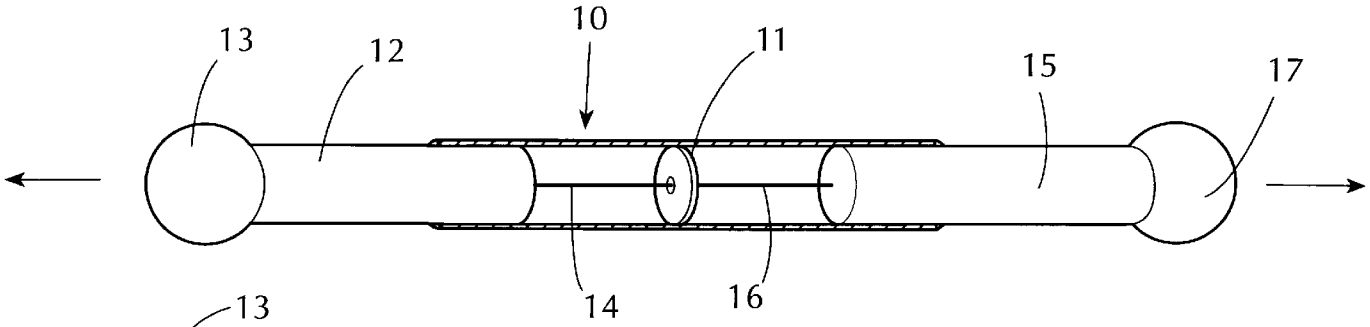
FIG. 2 is a longitudinal section taken through the baton.
Figure 3:
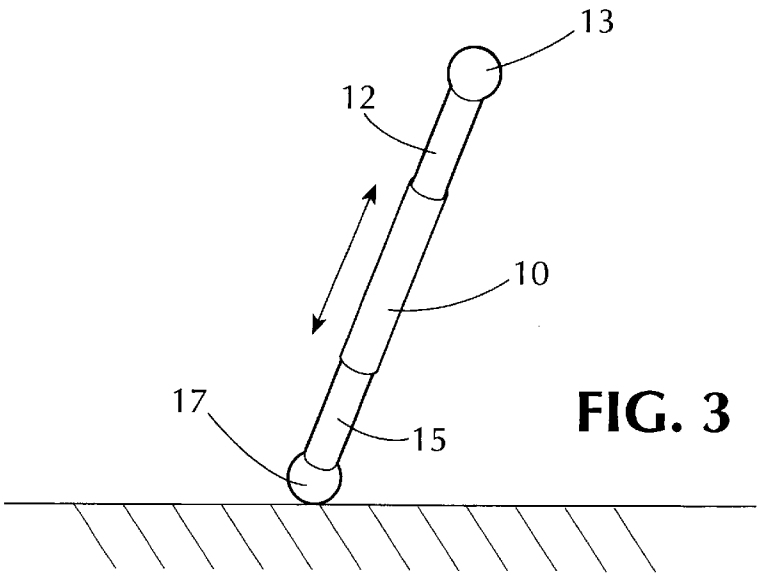
FIG. 3 shows the baton when hurled as a shaft toward the ground from which it bounces back to the hurler.
Figure 1:
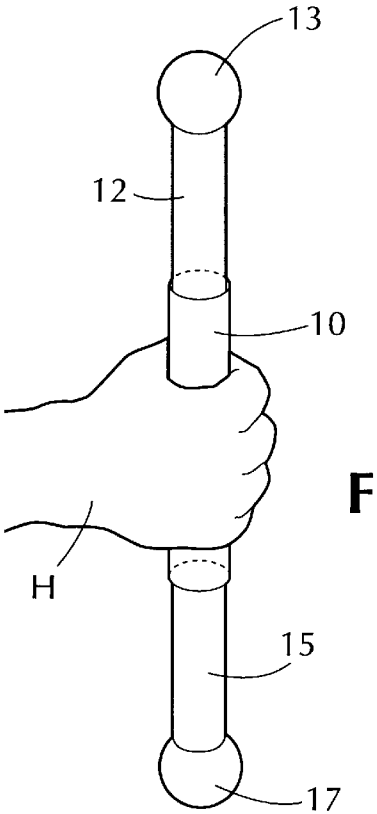
FIG. 1 is an elevational view of a baton in accordance with the invention.

Referring now to FIGS. 1 and 2, shown in these figures is a baton in accordance with the invention that includes an open-ended cylindrical main tube 10. This tube is formed of synthetic plastic material of high strength, such as polypropylene or polycarbonate.

Tube 10 is divided into opposing half-sections A and B by a transverse beam 11 anchored within the tube at its midpoint. Telescoping into section A through its open end and slidable therein is a cylindrical rod 12 having a length greater than that of section A. Secured to the outer end of rod 12 is a weighted ball 13, preferably made of rubber or other elastomeric material. The inner end of rod 12 is connected by a short band 14 of rubber or other stretchable material to beam 11. When rod 12 slides axially in section A away from beam 11, band 14 is then stretched to maintain the connection between the rod and beam and prevent the rod from coming entirely out of section A.

The rods which are slidable in the sections of the main tube are preferably formed of a plastic material having a low coefficient of sliding friction, such as ultra-high molecular weight polyethylene.

Telescoping into section B of the main tube 10 through its open end is a cylindrical rod 15 identical to rod 12. These rods may be made of a hollow plastic tubing whose ends are closed by plastic discs, or they may be made of solid plastic material.

The inner end of rod 15 is connected by a short elastic band 16 to beam 11. Secured to the other end of rod 15 is a weighted ball 17 identical to ball 13 at the opposing end of the baton. Hence in the static condition of the baton in which rods 12 and 15 are symmetrically arranged with respect to main tube 10, the baton then has a predetermined length that corresponds to the length of a conventional baton for use by a drum major or majorette.

In use, the drum major or majorette grasps the main tube 10 of the baton with a hand H and twirls the baton. This action causes the baton to expand in length to an extent that depends on the velocity of the twirling action during which the baton moves in a circular path and the opposing balls 13 and 17 are then subjected to centrifugal forces.

These forces seek to pull rods 12 and 15 in opposite directions out of half sections A and B of the main tube 10, these axial advances being resisted by the stretched elastic bands connecting the rods to center beam 11.

When the velocity of the twirling action diminishes and the forces of contraction of the stretched elastic bands 14 and 16 exceed the centrifugal forces exerted in the rods to pull them outwardly, the rods then retract inwardly into sections A and B of main tube 10.

Thus as the drum major or majorette twirls the baton, the faster the twirling action, the greater becomes the extended length of the baton and the greater becomes the visibility of the baton to spectators viewing the marching band.

This change in the length of the baton enhances the performance of the drum major or majorette, for while at the outset of the march the baton is of normal length, as the drum major or majorette steps up the twirling movement of the baton the baton responds to this activity by growing longer and more visible.

The drum major or majorette can execute other movements, such as hurling the baton toward the ground G as if it were a throwable shaft or spear. When rubber ball 17 at the tip of the baton strikes the ground, this causes the baton to bounce back in the direction of the hurler who can again grasp the baton and continue the march.

Thus as a marching drum major twirls his baton, he can on occasion vary his performance by hurling the baton toward the ground and then recover the baton when it bounces back, and again resume the twirling activity.

While there has been shown preferred embodiments of a variable-length twirlable baton in accordance with the invention, it is to be appreciated that many changes may be made therein without departing from the spirit of the invention. Thus instead of rubber bands to connect the ends of the rods to the beam in the middle of the main tube use may be made for this purpose of helical springs.

I claim:

1. A baton of variable length useable by a drum major or other user capable of twirling the baton, said baton comprising:

A. an open-ended cylindrical main tube that can be grasped by the user, said tube being divided into opposing half-sections by a transverse beam;

B. a pair of cylindrical rods telescoped within the respective half-sections of the tube, each rod being slidable in its half section and having a weighted mass secured to an outer end of the rod whereby the length of the baton is determined by the distance between the weighted masses; and C. stretchable means connecting an inner end of each rod to the beam whereby when the baton is twirled by the user, the resultant centrifugal forces acting on the weighted masses cause the rods to advance outwardly with respect to the half-sections of the tube to lengthen the baton.

2. A baton as set forth in claim 1, in which the main tube is formed of synthetic plastic material.

3. A baton as set forth in claim 1, in which the rods are formed of a plastic material having a low coefficient of sliding friction.

4. A baton as set forth in claim 3, in which the material is ultra-high molecular weight polyethylene.

5. A baton as set forth in claim 1, in which said weighted masses are formed by rubber balls.

6. A baton as set forth in claim 1, in which the stretchable means are rubber bands.

7. A baton as set forth in claim 1, in which the stretchable means are helical springs.

* * * * *